US005711260A

United States Patent [19]

Aupperle et al.

[11] Patent Number: 5,711,260

[45] Date of Patent: Jan. 27, 1998

[54] CYLINDER HEAD OF AN INTERNAL COMBUSTION ENGINE

[75] Inventors: Walter Aupperle, Korb; Horst Bärwaldt, Stuttgart, both of Germany

[73] Assignee: Mercedes-Benz AG, Stuttgart, Germany

[21] Appl. No.: 774,301

[22] Filed: Dec. 24, 1996

[30] Foreign Application Priority Data

Jan. 9, 1996 [DE] Germany ..... 196 00 441.1

[51] Int. Cl.[6] ..... F01L 1/18

[52] U.S. Cl. ..... 123/90.39; 123/193.5

[58] Field of Search ..... 123/90.39, 90.4, 123/90.41, 90.44, 193.5, 193.3; 74/519, 559

[56] References Cited

U.S. PATENT DOCUMENTS

| | | | |
|---|---|---|---|
| 4,617,883 | 10/1986 | Okuyama et al. | 123/90.39 |
| 5,005,544 | 4/1991 | Spangler | 123/195 R |
| 5,095,861 | 3/1992 | Dove, Jr. | 123/90.39 |
| 5,577,470 | 11/1996 | Leydorfk, Jr. et al. | 123/90.39 |

FOREIGN PATENT DOCUMENTS

| | | | |
|---|---|---|---|
| 1 911 299 | 1/1971 | Germany . | |
| 36 36 180A1 | 4/1988 | Germany . | |
| 3636180A1 | 4/1988 | Germany . | |
| 143178 | 9/1982 | Japan | 123/90.39 |
| 211514 | 12/1983 | Japan | 123/90.39 |
| 2 037 888 A | 7/1980 | United Kingdom . | |

*Primary Examiner*—Weilun Lo

*Attorney, Agent, or Firm*—Evenson McKeown Edwards & Lenahan, PLLC

[57] ABSTRACT

A cylinder head assembly of an internal combustion engine includes valves arranged in the cylinder head. For the purpose of driving each of the valves, a respective push rod is provided which is driven by a cam shaft and carries a rocker which is mounted on a rocker shaft. The rocker shaft is held in individual rocker brackets in such a way as to accommodate pivotable movement of the rockers about the said shaft. In order to obtain a rocker bracket which is easy to preproduce and requires virtually no further machining for installation, each rocker bracket has, at its upper end, a trough-shaped depression for the purpose of accommodating the rocker shaft.

22 Claims, 1 Drawing Sheet

CYLINDER HEAD OF AN INTERNAL COMBUSTION ENGINE

BACKGROUND AND SUMMARY OF THE INVENTION

The invention relates to a cylinder head of an internal combustion engine with valves arranged in the cylinder head, there being provided, for the purpose of driving each of the valves, a respective push rod which is driven by a cam shaft and carries a rocker which is mounted on a rocker shaft, the latter being held in individual rocker brackets, in such a way as to be pivotable about the said shaft.

A cylinder head of this kind is known, for example, from German Published Unexamined Patent Application DOS 3,636,180. The rocker brackets shown there are of U-shaped design and, in their U limbs, have respective holes for accommodating a pin which carries the respective rocker. The individual rocker brackets are connected to the cylinder head by means of screwed joints. If, instead of individual pins for each rocker, the intention is to use a common rocker shaft about which the rockers can be pivoted, there is the problem that the holes in the limbs of the rocker brackets have to be machined very accurately to allow the rocker shaft to be used. This requires very great precision in the preproduction of the rocker brackets with a correspondingly high outlay on production and finishing for installation on the cylinder head.

It is an object of the present invention to develop a rocker bracket, the preproduction of which is simple and which requires virtually no further machining for installation on the cylinder head.

This object is achieved by providing an arrangement wherein the rocker bracket has tab-like bendable extensions on side parts of the trough-shaped depression which surround and hold the rocker shaft.

In the case of a generic cylinder head with individual rocker brackets for each rocker, these rocker brackets are designed in such a way that, on their upper side, they have a trough-shaped depression into which the rocker shaft is inserted. In this way, it is possible to avoid the need to provide separate holes to accommodate the rocker shaft in the rocker bracket, which have to be produced with the corresponding precision. Any adaptations which are still required can be performed in a simple manner by machining the underside of the rocker bracket, by means of which the said rocker bracket rests on the cylinder head.

According to a particular configuration of the invention, the trough-shaped depression in the rocker bracket reaches around the rocker shaft as far as the region of its center plane, with the result that the rocker shaft is not sufficiently surrounded. To improve the accommodation of the rocker shaft in the rocker bracket, the side parts of the rocker bracket which surround the rocker shaft can have, over at least part of their length, additional tab-like extensions which reach further around the rocker shaft on both sides. This further improves the seating of the rocker shaft in the rocker bracket.

The rocker bracket can, for example, be manufactured from die-casting alloy or, alternatively, from plastic, in which case the tab-like extensions can then be designed in such a way that they can be bent inwards and can thus be adapted to the circumference of the rocker shaft and rest against it. It is also conceivable for the tab-like extensions to have already been preshaped in such a way that they can serve as a clip-like receptacle for the rocker shaft.

To secure the rocker shaft additionally in the rocker bracket, a retention device which covers the remaining, upper area of the rocker shaft, reaches around this area of the rocker shaft and, together with the rocker bracket, is bolted to the cylinder head, can be provided.

In another configuration of the invention, the rocker bracket according to the invention can have a widened portion on its side in the region of the surface by which it rests on the cylinder head, and a guide hole is made in this widened portion, through which a cylinder-head cover bolt is passed and screwed to the cylinder head. In this way, it is possible to ensure that the relatively long cylinder-head cover bolts can be introduced in a simple manner through this widened portion into the corresponding hole in the cylinder head.

Other objects, advantages and novel features of the present invention will become apparent from the following detailed description of the invention when considered in conjunction with the accompanying drawings.

DETAILED DESCRIPTION OF THE DRAWINGS

Figure 1:
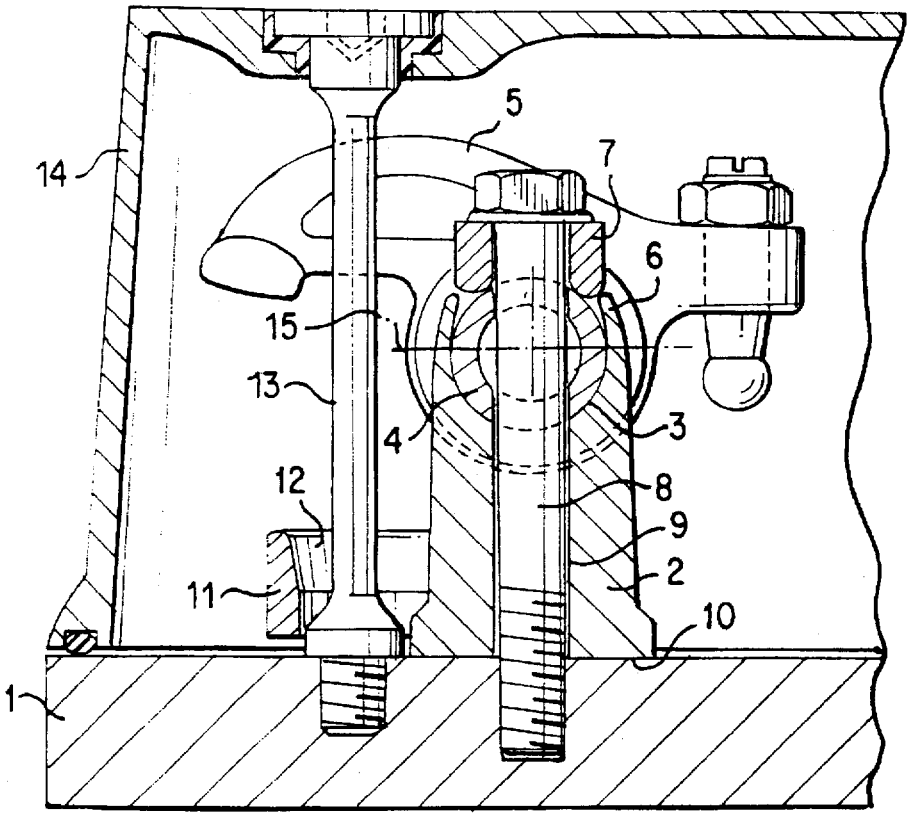
FIG. 1 shows a cross-section through part of a cylinder head with a rocker bracket according to the FIG. 2 shows a rocker bracket according to the invention.
Figure 2:
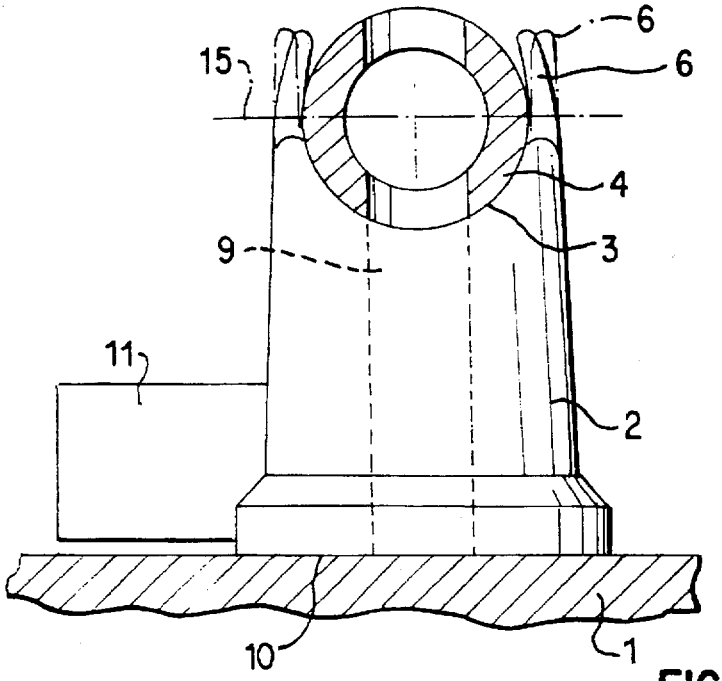

The figures show a rocker bracket 2, the supporting surface 10 of which is seated on the cylinder head 1. Inserted into the trough-shaped depression 3 of the rocker bracket 2 is a rocker shaft 4, which supports the rocker 5 in such a way that it can pivot. The rocker bracket 2 can be composed, for example, of die-casting alloy or, alternatively, of plastic. The side walls of the rocker bracket 2 reach around the rocker shaft 4 into the region of its center plane 15. In addition, upward-projecting tab-like extensions 6 are provided over at least part of the length of these side walls, these extensions being designed in such a way that they can be bent inwards and can thus be laid against the circumference of the rocker shaft 4 over a relatively large area beyond the center plane 15 of the rocker shaft 4 and thereby hold the rocker shaft 4.

The rocker bracket 2 and the rocker shaft 4 have a hole 9 through which is passed a bolt 8 which bolts the rocker shaft 4 and the rocker bracket 2 to the cylinder head 1 and holds them against it. For this purpose, a cap-like retention device 7, against which the bolt 8 is supported, can be placed on the remaining part of the circumference of the rocker shaft 4, that part which is not yet surrounded.

On one side of its lower area, approximately am the level of the surface 10 of support on the cylinder head 1, the rocker bracket 2 has a widened portion which serves as a guide element 11 and in which a guide hole 12 is provided. This serves for the easy insertion and the guidance of a cylinder-head cover bolt 13 by means of which the cylinder head cover 14 can be bolted to the cylinder head 1.

It should be understood that the present invention is not limited to the exemplary embodiment described, this representing only a particularly advantageous embodiment.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cylinder head of an internal combustion engine with valves arranged in the cylinder head, there being provided, for the purpose of driving each of the valves, a rocker which is mounted on a rocker shaft, the rocker shaft being held on at least one rocker bracket, the rocker being mounted in such a way as to be pivotable about the rocker shaft, the rocker bracket having, at its upper end, a trough-shaped depression for the purpose of accommodating the rocker shaft, and the rocker bracket and the cylinder head being separate components, wherein the rocker bracket has tab-like bendable extensions on side parts of the trough-shaped depression which surround and hold the rocker shaft.

2. Cylinder head according to claim 1, wherein the trough-shaped depression accommodates the rocker shaft at least to a region of a center plane of the rocker shaft.

3. Cylinder head according to claim 1, wherein said tab-like extensions extend over part of a length of the side parts of the trough-shaped depression which surround the rocker shaft.

4. Cylinder head according to claim 1, wherein the rocker bracket has a guide hole for the purpose of accommodating a cylinder-head cover bolt in a region of a surface at which it is fastened to the cylinder head.

5. Cylinder head according to claim 3, wherein the rocker bracket has a guide hole for the purpose of accommodating a cylinder-head cover bolt in a region of a surface at which it is fastened to the cylinder head.

6. Cylinder head according to claim 1, wherein the rocker bracket is manufactured as a die casting.

7. Cylinder head according to claim 1, wherein the rocker bracket is manufactured from plastic.

8. Cylinder head according to claim 1, wherein the tab-like extensions can be bent to hold the rocker shaft.

9. Cylinder head according to claim 8, wherein the tab-like extensions are designed as clips.

10. Cylinder head according to claim 1, wherein at least one rocker bracket is provided with a retention device for holding the rocker shaft.

11. Cylinder head according to claim 10, wherein the retention device is bolted to the cylinder head together with the rocker bracket by means of a screw fastener.

12. Cylinder head according to claim 1, wherein the tab-like extensions are designed as clips.

13. Cylinder head according to claim 5, wherein at least one rocker bracket is provided with a retention device for holding the rocker shaft.

14. Cylinder head according to claim 13, wherein the retention device is bolted to the cylinder head together with the rocker bracket by means of a screw fastener.

15. Cylinder head according to claim 14, wherein the rocker bracket is manufactured as a die casting.

16. Cylinder head according to claim 14, wherein the rocker bracket is manufactured from plastic.

17. A rocker support assembly for supporting a plurality of rockers of an internal combustion engine at an engine cylinder head, comprising:

a rocker shaft for pivotally supporting the rockers, and at least one rocker bracket detachably attachable to the cylinder head and having a trough shaped depression facing away from the cylinder head and accommodating the rocker shaft, wherein side parts of the depression extend above the depression and form bendable tab like extensions which hold the rocker shaft on the depression.

18. A rocker support assembly according to claim 17, wherein the rocker bracket has a guide hole for the purpose of accommodating a cylinder-head cover bolt in a region of a surface at which it is fastened to the cylinder head.

19. A rocker support assembly according to claim 17, wherein the rocker bracket is manufactured as a die casting.

20. A rocker support assembly according no claim 17, wherein the rocker bracket is manufactured from plastics.

21. A rocker support assembly according to claim 17, wherein the tab-like extensions can be plastically deformably bent to hold the rocker shaft.

22. A rocker support assembly according to claim 17, wherein the tab-like extensions form elastically bendable clips to hold the rocker shaft.

* * * * *